US009168728B2

(12) United States Patent
Roskosch et al.

(10) Patent No.: US 9,168,728 B2
(45) Date of Patent: Oct. 27, 2015

(54) PRINTING UNIT HAVING A DISTRIBUTOR ROLLER WITH A SEPARATE DRIVE MOTOR AND PRINTING PRESS HAVING THE PRINTING UNIT

(71) Applicant: HEIDELBERGER DRUCKMASCHINEN AG, Heidelberg (DE)

(72) Inventors: Bernhard Roskosch, Wiesloch (DE); Michael Schwandt, Forst (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 13/680,471

(22) Filed: Nov. 19, 2012

(65) Prior Publication Data

US 2013/0305939 A1 Nov. 21, 2013

(30) Foreign Application Priority Data

May 15, 2012 (DE) ..... 20 2012 004 791 U

(51) Int. Cl.
*B41F 7/02* (2006.01)
*B41F 31/15* (2006.01)

(52) U.S. Cl.
CPC .. *B41F 7/02* (2013.01); *B41F 31/15* (2013.01)

(58) Field of Classification Search
CPC ..... B41F 31/15
USPC ..... 101/217
See application file for complete search history.

(56) References Cited

U.S. PATENT DOCUMENTS

| | | | | |
|---|---|---|---|---|
| 3,916,791 | A * | 11/1975 | Simeth | 101/141 |
| 5,158,019 | A * | 10/1992 | Miescher et al. | 101/350.3 |
| 6,222,294 | B1 * | 4/2001 | Stacy et al. | 310/112 |
| 6,526,888 | B2 * | 3/2003 | Douillard et al. | 101/484 |
| 6,543,355 | B1 * | 4/2003 | Stiel | 101/248 |
| 6,578,481 | B1 | 6/2003 | Beisel et al. | |
| 6,634,292 | B2 | 10/2003 | Fujiwara et al. | |
| 7,077,061 | B2 * | 7/2006 | Holm et al. | 101/212 |
| 7,568,426 | B2 * | 8/2009 | Koppelkamm | 101/350.2 |
| 8,322,281 | B2 * | 12/2012 | Fischer | 101/349.1 |
| 8,499,690 | B2 * | 8/2013 | Schwitzky | 101/152 |
| 2002/0066386 | A1 * | 6/2002 | Douillard et al. | 101/483 |
| 2003/0097944 | A1 * | 5/2003 | Fukushima et al. | 101/350.3 |
| 2005/0016399 | A1 * | 1/2005 | Holm et al. | 101/352.06 |
| 2009/0145315 | A1 * | 6/2009 | Schafer et al. | 101/217 |
| 2010/0319560 | A1 * | 12/2010 | Fischer | 101/349.1 |
| 2011/0185926 | A1 * | 8/2011 | Blaney et al. | 101/217 |

FOREIGN PATENT DOCUMENTS

| | | |
|---|---|---|
| DE | 19756077 A1 | 6/1999 |
| EP | 1167026 B1 | 5/2006 |

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A printing unit for a printing press includes a plurality of distributor rollers for carrying out an axial movement. At least one of the distributor rollers is associated with a separate drive motor exclusively for driving the axial movement and is adjustable independently of the movements of the other distributor rollers by using a control device.

7 Claims, 2 Drawing Sheets

PRINTING UNIT HAVING A DISTRIBUTOR ROLLER WITH A SEPARATE DRIVE MOTOR AND PRINTING PRESS HAVING THE PRINTING UNIT

CROSS-REFERENCE TO RELATED APPLICATION

This application claims the priority, under 35 U.S.C. §119, of German Patent Application DE 20 2012 004 791.4, filed May 15, 2012; the prior application is herewith incorporated by reference in its entirety.

BACKGROUND OF THE INVENTION

Field of the Invention

The present invention relates to a printing unit for a printing press including a plurality of distributor rollers provided to carry out an axial distributing movement. The invention also relates to a printing press having at least one printing unit.

Most sheet-fed lithographic offset printing presses have printing units that include inking units with multiple distributor rollers. The distributor rollers are provided to even out or smooth the ink that has been taken from an ink fountain across the entire printing width. For that purpose, in addition to their rotary movement, those distributor rollers carry out an axial stroke movement. Due to the axial stroke and the resultant friction between the rollers, the ink is distributed in a direction perpendicular to the direction of sheet travel. The axial stroke movement may also be referred to as a reciprocating movement. A suitable drive is necessary to drive the rotary and reciprocating movements of the distributor rollers. German Patent Application DE 197 56 077 A1, corresponding to U.S. Pat. No. 6,578,481, discloses a method of operating an inking unit in a rotary printing press wherein the inking unit includes at least one ink distributor roller that axially oscillates at a variable stroke amplitude. Thus the stroke amplitude of the axial stroke movement of a number of ink distributor rollers is adjustable. For example, it is possible to increase the stroke amplitude in a targeted way before the start of the printing operation. The one or more distributor rollers are driven in a purely mechanical way by a distributor stroke drive. The stroke of all ink distributor rollers in the inking unit is only jointly changeable. However, such a change of the stroke of the distributor rollers in the inking unit is not very flexible and is mechanically complex.

European Patent EP 1 167 026 B1, corresponding to U.S. Pat. No. 6,634,292, discloses a printing press wherein the rotary movement and the axial stroke movement of the distributor roller are uncoupled from each other in the inking unit. For that purpose, the inking unit includes a first motor for driving the rotary movement of the distributor roller and a second motor for driving the axial movement of the ink distributor roller. In addition, a clutch is provided for interrupting the rotary movement by uncoupling the first motor from the distributor roller. A disadvantage of that construction is that it is mechanically complex in that it requires a clutch for interrupting the rotary movement. The patent does not indicate how further distributor rollers in the same inking unit are driven.

SUMMARY OF THE INVENTION

It is accordingly an object of the invention to provide a printing unit having a distributor roller with a separate drive motor and a printing press having the printing unit, which overcome the hereinafore-mentioned disadvantages of the heretofore-known printing units and printing presses of this general type and which allow flexible operation of multiple distributor rollers in the inking unit of a printing unit.

With the foregoing and other objects in view there is provided, in accordance with the invention, a printing unit for a printing press, comprising a plurality of distributor rollers provided to carry out an axial movement. At least one of the distributor rollers has a separate drive motor exclusively for driving the axial movement and is adjustable independently of the axial movements of the other distributor rollers by using a control device.

The present invention may in general be used in any lithographic offset printing press that includes an inking unit with multiple distributor rollers in the printing unit. The distributor rollers are provided to smooth the ink in the inking unit by axial movements and superimposed rotary movements. In accordance with the present invention, at least one of the distributor rollers has a separate drive motor exclusively for driving the axial movement and is adjustable independently of the axial movements of the other distributor rollers through the use of a control device. The separate drive motor now allows adjustment of the axial movement of a distributor roller in a manner completely independent of other distributor rollers in the same inking unit. Since the separate drive motor is exclusively provided for driving the axial movement of a distributor roller, the axial stroke movement of the distributor roller is easily adjustable independently of other distributor rollers and of other movements such as the rotary movement. Axial stroke movements of any desired lengths are continuously adjustable. The adjustment of the axial stroke movement may be conveniently made by using a control device on the printing press. This control device may be a touch screen that is also used for making any other adjustments on the printing press. The adjustment of the axial stroke movement of individual distributor rollers in the inking unit of a printing unit is now completely independent of other distributor rollers and can be made by the printing press operator in a convenient, easy and focused way.

In accordance with another feature of the invention, at least two of the multiple distributor rollers have their own drive motor exclusively for driving the axial movement, and adjustments of the axial stroke movements driven by the separate drive motors are independent of each other and can be made on a control device. In a particularly preferred embodiment of the invention, all distributor rollers have their own drive motor, thus allowing separate and independent adjustment of the axial distributing movement of each individual distributor roller in the inking unit through the use of the control device of the printing press. Thus continuous adjustment of all distributor rollers in an inking unit is possible. In particular, the phasing of the distributor rollers relative to each other is easily adjustable. Each of the separate drive motors is connected to a control unit of the printing press, which in turn communicates with the control device. This means that no separate computer is required to actuate the separate drive motors. Instead, it is sufficient to use the available control unit of the printing press to actuate the axial stroke movement of the separate drive motors.

In accordance with a further advantageous feature of the invention, the separate drive motor of the distributor roller may be a rotating electric motor that transmits power to the distributor roller through the use of a rotary clutch and a recirculating ball screw. In this embodiment, an electric servo motor may be used having a rotary movement that is converted into an axial movement using a ball screw nut and a recirculating ball screw. When the direction of rotation of the servo drive changes, the direction of movement of the ball screw will be reversed and a reciprocating movement can be created.

In accordance with an added feature of the invention, the separate drive motor of the distributor roller is a linear motor having a solenoid actuator. In this case, no rotating elements need be provided since the linear motor operates in accordance with the principle of a maglev train, which is propelled exclusively by switching on and off appropriate driving magnets. In this case, too, a reversal of the axial movement must be achieved. This is attained by actuating the magnets in a reverse way so that the distributor rollers are axially moved in opposing directions.

In accordance with an additional feature of the invention, different selectable modes of operation for actuating the distributor rollers, in particular the modes "regular printing mode," "iris mode" and "inking unit washing mode" may be stored in the control unit. These selectable modes of operation facilitate adjustment of the distributor rollers because the printing press operator does not have to adjust all distributor rollers by himself or herself but can select one of the selectable modes of operation. Each mode of operation is associated with a corresponding axial stroke movement of a distributor roller. In addition to the length of the axial stroke movement, the corresponding phase position may also be associated. For the iris mode, for example, a phasing of the distributor rollers different from the regular printing mode is stored. For the regular printing mode, the phasing of the distributor rollers relative to each other is optimized in terms of minimum ink waste and the prevention of ghosting and streaks. For the iris mode, a large phase offset of 180°, for example, is preferred. For the inking unit washing mode, a maximum axial stroke movement is set to make the washing operation particularly efficient. In addition, a second mode may be provided for the regular printing operation wherein the phasing is set with a focus on avoiding ghosting. This allows the operator to quickly select the suitable mode of operation without having to select the correct phasing and axial stroke movement for each individual distributor roller in the inking unit of the printing unit himself or herself, a process which would otherwise be very time-consuming especially for long printing presses that include many printing units.

In accordance with yet another particularly preferred feature of the invention, the settings for the axial stroke or phasing of the distributor rollers are storable in the control unit in connection with a print job and are retrievable for repeat jobs. The printing press operator may store the settings that have once been selected as optimum settings for one or more distributor rollers for a specific print job, with the print job, and may retrieve them for a repeat order. This will save the operator the trouble of painstakingly having to make the settings once again in case of a repeat order.

In accordance with yet a further feature of the invention, the axial movement of the distributor rollers that are driven by a separate drive motor is detected by a sensor. This sensor is provided to ensure that the axial movement of the distributor roller is correct. For this purpose, the sensor may feed the actual axial movement back to the control unit and may actuate the separate drive motor accordingly as required to ensure that the separate drive motor actually causes the driven distributor roller to rotate at the desired phase and to carry out the desired axial stroke movement. This is a way to create a closed control loop for controlling the separate drive motor through the use of the control and the sensor.

In accordance with yet an added advantageous feature of the invention, when an inking unit washing operation is initiated in the printing unit, the control unit may automatically select the "inking unit washing" mode for the distributor rollers that are driven by separate drive motors. In this case, the operator does not even have to select the suitable mode of operation for the drives of the distributor rollers for the washing operation. Instead, it is sufficient to initiate the inking unit washing operation at the control of the printing press, and the inking unit washing mode will automatically be selected for the distributor rollers.

With the objects of the invention in view, there is concomitantly provided a printing press, comprising at least one printing unit according to the invention.

Other features which are considered as characteristic for the invention are set forth in the appended claims.

Although the invention is illustrated and described herein as embodied in a printing unit having a distributor roller with a separate drive motor and a printing press having the printing unit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
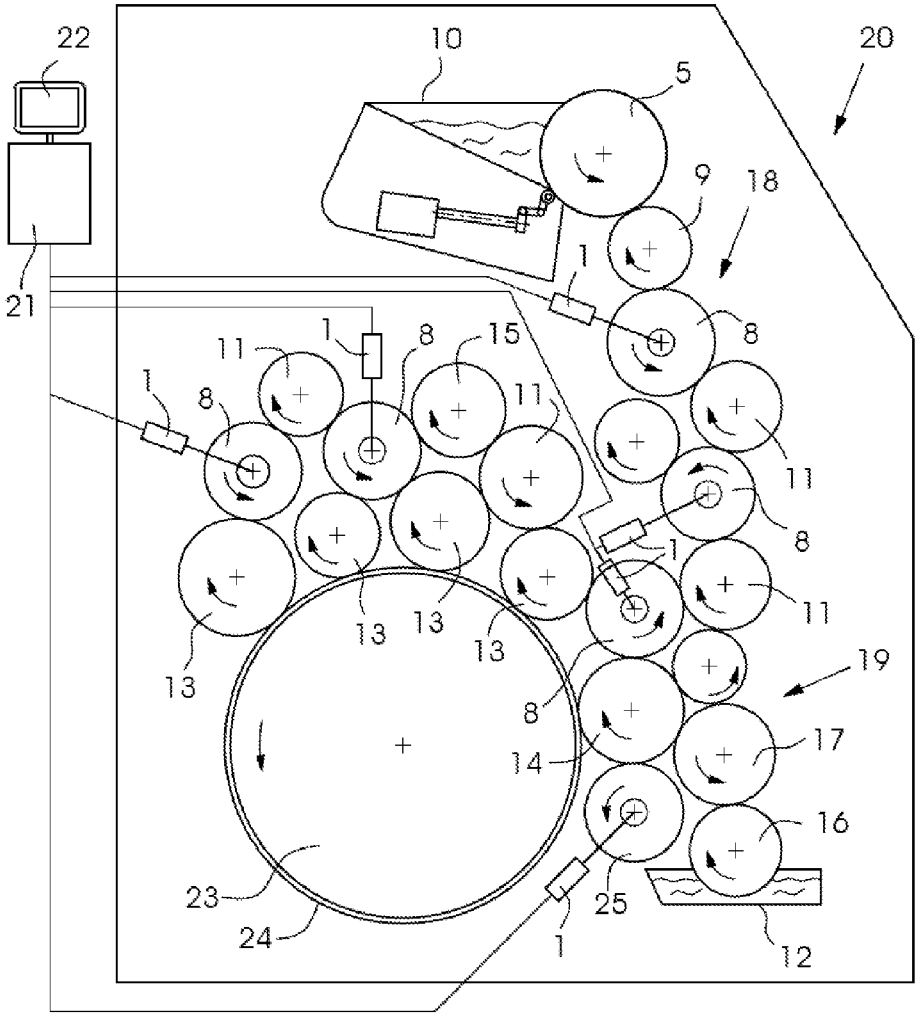
FIG. 1 is a diagrammatic, vertical-sectional view of a printing unit including an inking unit, a dampening unit, a plate cylinder and an associated control device.

Referring now to the figures of the drawings in detail and first, particularly, to FIG. 1 thereof, there is seen a structure of a printing unit 20 of a sheet-fed lithographic rotary offset printing press. The printing press also includes a number of other, non-illustrated, printing units 20. A blanket cylinder, a transport cylinder and an impression cylinder of the printing unit 20 are not shown. A plate cylinder 23 carries a printing plate 24 that contains an image to be printed.

The printing unit 20 includes a dampening unit 19 and an inking unit 18 for applying printing ink to the plate cylinder 23. The inking unit 18 and the dampening unit 19 include numerous rollers for optimizing distribution of ink on the printing plate 24 on the plate cylinder 23. The inking unit 18 has an ink fountain 10 that contains a supply of ink. Ink is taken up out of the ink fountain 10 by an ink fountain roller 5, which transfers the ink to a vibrator roller 9. A first distributor roller 8 for smoothing the ink in the axial direction is provided below the film roller 9. The inking unit 18 includes further distributor rollers 8 for the same purpose. As shown in FIG. 1, each of the distributor rollers 8 includes a separate drive motor 1 for driving the axial distributing movement. A dampening fluid distributor roller 25 likewise has its own drive motor 1. The rotary movement of the distributor rollers 8 may likewise be driven by a separate drive motor. However, the rotary movement of the distributor rollers may alternatively be driven by a central inking unit drive. Ink applicator rollers 13 roll on the printing plate 24 disposed on the plate cylinder 23 to transfer and apply the ink that has been smoothed in the inking unit 18 to the printing plate 24.

The dampening unit 19 includes a dampening fluid container 12 that contains a supply of dampening fluid provided to influence the viscosity of the ink. The dampening fluid is taken up out of the dampening fluid container 12 by a dip or scooping roller 16, which transfers the dampening fluid to a dampening fluid transfer roller 17. The dampening fluid transfer roller 17 in turn transfers the dampening fluid to a dampening fluid applicator roller 14 and to the surface of the printing plate 24. In addition, the dampening unit 19 includes the separately driven dampening fluid distributor roller 25 for laterally distributing the dampening fluid. As mentioned above, this dampening fluid distributor roller 25 is also equipped with its own motor 1 for adjusting the axial stroke movement. The way in which the rotary movement of the individual rollers in the inking unit 18 and in the dampening unit 19 is driven is not the object of the present invention and will therefore not be explained in any detail herein. One option is to provide clutches for coupling the rollers to the drive of the plate cylinder 23 to drive their rotary movement. Another option is to provide corresponding individual drive motors.

All of the drive motors 1 for driving the axial distributing movement of the distributor rollers 8 are connected to a control unit 21. This control unit 21 may be the control unit of a printing press. The control unit 21 includes a display and control device such as a screen 22, preferably embodied as a touch screen. Depending on the required mode of operation, the operator of the printing press may use the touch screen 22 to set and adjust the stroke and/or the phasing of the distributor roller drives by actuating the drive motors 1 of the distributor rollers 8 or he or she may access stored programs.

Figure 2:
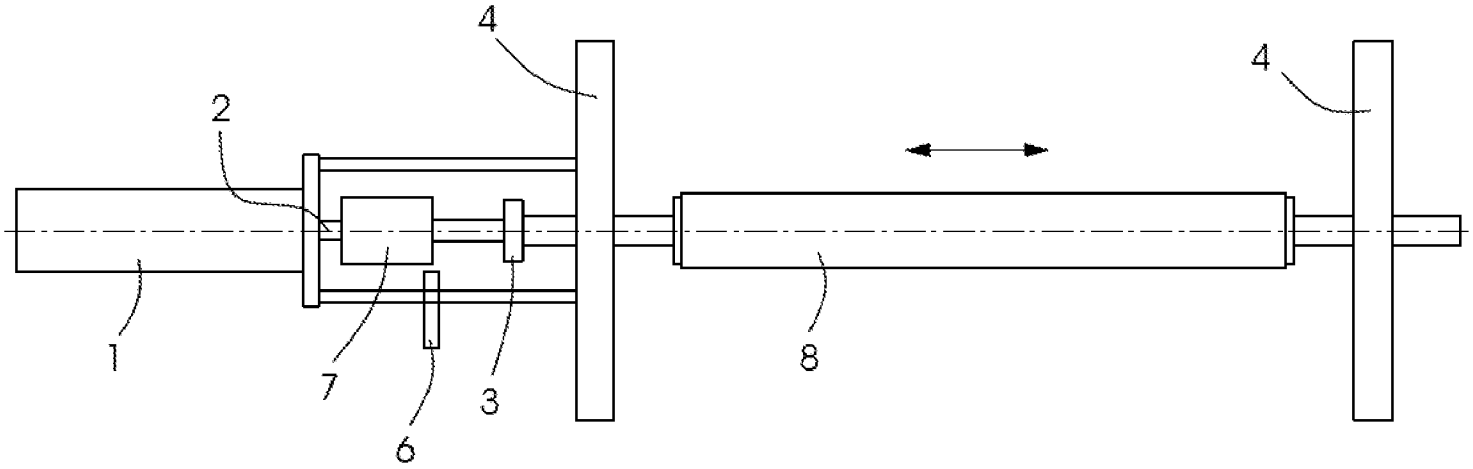
FIG. 2 is an enlarged, side-elevational view of a separate drive motor for axial movement of a distributor roller in an inking unit.

FIG. 2 illustrates the separate drive for a distributor roller 8. The drive is formed of a drive motor 1 for driving a rotary motion. The drive motor 1 is embodied as a servomotor. The axially movable distributor roller 8 is disposed for axial movement between side walls 4 of the printing unit 20. A spur-toothed gear 3 meshing with a central distributor roller driving gear may be provided for driving the rotary movement of the distributor roller 8. The central distributor roller driving gear is not illustrated and may be coupled with the rotary drive of the plate cylinder 23. However, the axial stroke movement of the distributor roller 8 is exclusively driven by the separate drive motor 1, which is firmly connected to the side wall 4 of the printing unit 20. The rotary movement of the drive motor 1 is converted into an axial movement by a transmission. For this purpose, the drive includes a recirculating ball screw 2 supported in a rotating ball screw nut that is electrically driven by the drive motor 1. Due to the rotary movement of the ball screw nut, the ball screw 2 moves in an axial direction. A reversal of the direction of rotation of the motor 1 and of the ball screw nut 2 causes the direction of movement of the recirculating ball screw 2 to change. Therefore, by changing the rotary movement of the drive motor 1, the recirculating ball screw 2 may carry out an axial stroke movement, thus driving the axial movement of the distributor roller 8. A rotary clutch 7 is provided as a connecting element between the rotating distributor roller journal and the non-rotating recirculating ball screw 2. In this way, the rotary movement of the distributor roller 8 may be separated from the axial stroke movement of the recirculating ball screw 2.

In order to be able to precisely control the stroke movements of the distributor roller 8, the position of the distributor roller 8 in the axial direction needs to be known and adjusted in a targeted way. An inductive sensor 6 is provided to detect the position for the purpose of controlling the stroke. When the distributor roller is in the central position, the sensor 6 is only just covered by the housing edge of the rotary clutch 7. This signal can thus be used to detect the central position of the distributor roller 8. When the distributor roller 8 is moved out of the central position in the direction of the right-hand side wall 4, the sensor signal is maintained. When the distributor roller 8 moves in the direction of the left-hand side wall 4, the sensor signal stops. Thus, the direction of movement of the distributor roller 8 can also be detected, for example to be able to adjust the desired phasing relative to the further distributor rollers 8. All of the distributor rollers 8 in the printing unit 20 shown in FIG. 1 may be equipped with the corresponding drive device shown in FIG. 2.

The invention claimed is:

1. A printing unit for a printing press, the printing unit comprising:

a plurality of distributor rollers configured to carry out an axial movement;

at least one separate drive motor each configured to exclusively drive said axial movement of a respective one of said distributor rollers;

at least one rotary clutch and at least one recirculating ball screw, said at least one separate drive motor for said distributor rollers being at least one rotating electric motor transmitting power to said distributor rollers through said at least one rotary clutch and said at least one recirculating ball screw;

a sensor detecting said axial movement of said distributor rollers driven by said at least one separate drive motor; and a control unit storing different selectable modes of operation of said distributor rollers, said modes of operation including a regular printing mode, an iris mode and an inking unit washing mode, said control unit being connected to a control device configured to adjust said at least one separate drive motor to drive said axial movement of said respective one of said distributor rollers independently of axial movements of others of said distributor rollers.

2. The printing unit according to claim 1, wherein said control unit stores phase positions of said distributor rollers driven by said at least one separate drive motor.

3. The printing unit according to claim 1, wherein said control unit is configured to store settings for a stroke and a phase position of said distributor rollers in connection with a print job and said settings are retrievable for a repeat job.

4. The printing unit according to claim 1, wherein said control unit is configured to automatically select said inking unit washing mode of operation for said distributor rollers driven by said at least one separate drive motor, upon initiation of an inking unit washing operation in the printing unit.

5. A printing press, comprising at least one printing unit according to claim 1.

6. The printing unit according to claim 1, wherein in said regular printing mode, a phasing of said distribution rollers is optimized in terms of ink waste and a prevention of ghosting and streaks.

7. The printing unit according to claim 1, wherein at least two of said plurality of distributor rollers are each driven by a respective one of said drive motors exclusively for driving said axial movement, and said axial movements driven by said separate drive motors are adjustable independently of each other by said control device.

* * * * *